US008998147B2

(12) United States Patent
Bohlmann et al.

(10) Patent No.: US 8,998,147 B2
(45) Date of Patent: Apr. 7, 2015

(54) TRAIN CONTROL SYSTEM WITH PULSE-CODE-MODULATED CAB SIGNALING

(75) Inventors: Peer Bohlmann, Schoenwalde (DE); Gerald Lude, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/117,875

(22) PCT Filed: May 10, 2012

(86) PCT No.: PCT/EP2012/058621

§ 371 (c)(1),
(2), (4) Date: Nov. 15, 2013

(87) PCT Pub. No.: WO2012/156268

PCT Pub. Date: Nov. 22, 2012

(65) Prior Publication Data

US 2014/0103167 A1 Apr. 17, 2014

(30) Foreign Application Priority Data

May 18, 2011 (DE) ..... 10 2011 076 047

(51) Int. Cl.
*B61L 21/00* (2006.01)
*B61L 1/18* (2006.01)
(Continued)

(52) U.S. Cl.
CPC ..... *B61L 1/188* (2013.01); *B61L 3/246* (2013.01); *B61L 23/22* (2013.01)

(58) Field of Classification Search
USPC ..... 246/62, 26, 24, 95, 98, 219, 167 R, 246/473 R, 20, 4, 6
See application file for complete search history.

(56) References Cited

U.S. PATENT DOCUMENTS 3,829,682 A * 8/1974 Geiger ..... 246/125
5,330,135 A * 7/1994 Roberts ..... 246/34 R
5,467,946 A * 11/1995 Doehler ..... 246/122 A
(Continued)

FOREIGN PATENT DOCUMENTS

CN 101554876 A 10/2009
CN 101574977 A 11/2009
(Continued)

OTHER PUBLICATIONS

Gellermann, Wolf Dieter, et al., "Die moderne Zugbeeinflussung mit Informationsübertragung über die Fahrschienen", Signal + Draht, Jun. 1, 1992, pp. 158-164, vol. 84., No. 6, Telzlaff Verlag GmbH, Darmstadt, Germany.

*Primary Examiner* — Jason C Smith
(74) *Attorney, Agent, or Firm* — Laurence A. Greenberg; Werner H. Stemer; Ralph E. Locher

(57) ABSTRACT

A train control system with pulse code-modulated cab signaling, especially for defining traveling speeds, includes a code generator acting upon a signal generator in dependence on a direction of travel. An output signal of the signal generator is supplied to a current track circuit covering a track section. In order to economize on components, the signal generator includes a transmitting device for modulating the input signals of both code generators. The transmitting device is connected to circuit connection adaptation devices on one of two entry ends of the track section through travel direction-specific outputs.

4 Claims, 1 Drawing Sheet

(51) Int. Cl.
*B61L 3/24* (2006.01)
*B61L 23/22* (2006.01)

(56) References Cited

U.S. PATENT DOCUMENTS

| | | | | |
|---|---|---|---|---|
| 6,102,340 | A * | 8/2000 | Peek et al. | 246/121 |
| 7,502,671 | B2 * | 3/2009 | Wilms | 701/19 |
| 7,954,770 | B2 * | 6/2011 | Tomlinson et al. | 246/122 R |
| 8,387,925 | B2 * | 3/2013 | Aisa et al. | 246/34 B |
| 2008/0173770 | A1 * | 7/2008 | Ruggiero et al. | 246/167 R |
| 2009/0194643 | A1 * | 8/2009 | Bohlmann et al. | 246/122 R |
| 2010/0327125 | A1 * | 12/2010 | Braband et al. | 246/62 |
| 2011/0284697 | A1 * | 11/2011 | Altamura et al. | 246/4 |
| 2011/0309204 | A1 * | 12/2011 | Bohlmann et al. | 246/122 R |
| 2011/0315828 | A1 * | 12/2011 | Bohlmann et al. | 246/167 R |
| 2014/0014783 | A1 * | 1/2014 | Lude et al. | 246/122 R |
| 2014/0103166 | A1 * | 4/2014 | Asuka et al. | 246/4 |
| 2014/0103167 | A1 * | 4/2014 | Bohlmann et al. | 246/62 |

FOREIGN PATENT DOCUMENTS

| | | | |
|---|---|---|---|
| CN | 201400196 | Y | 2/2010 |
| DE | 3436431 | A1 | 4/1986 |
| DE | 4413183 | A1 | 10/1995 |
| DE | 60300486 | T2 | 2/2006 |
| DE | 102005037801 | A1 | 2/2007 |
| EP | 1338492 | A1 | 8/2003 |

* cited by examiner

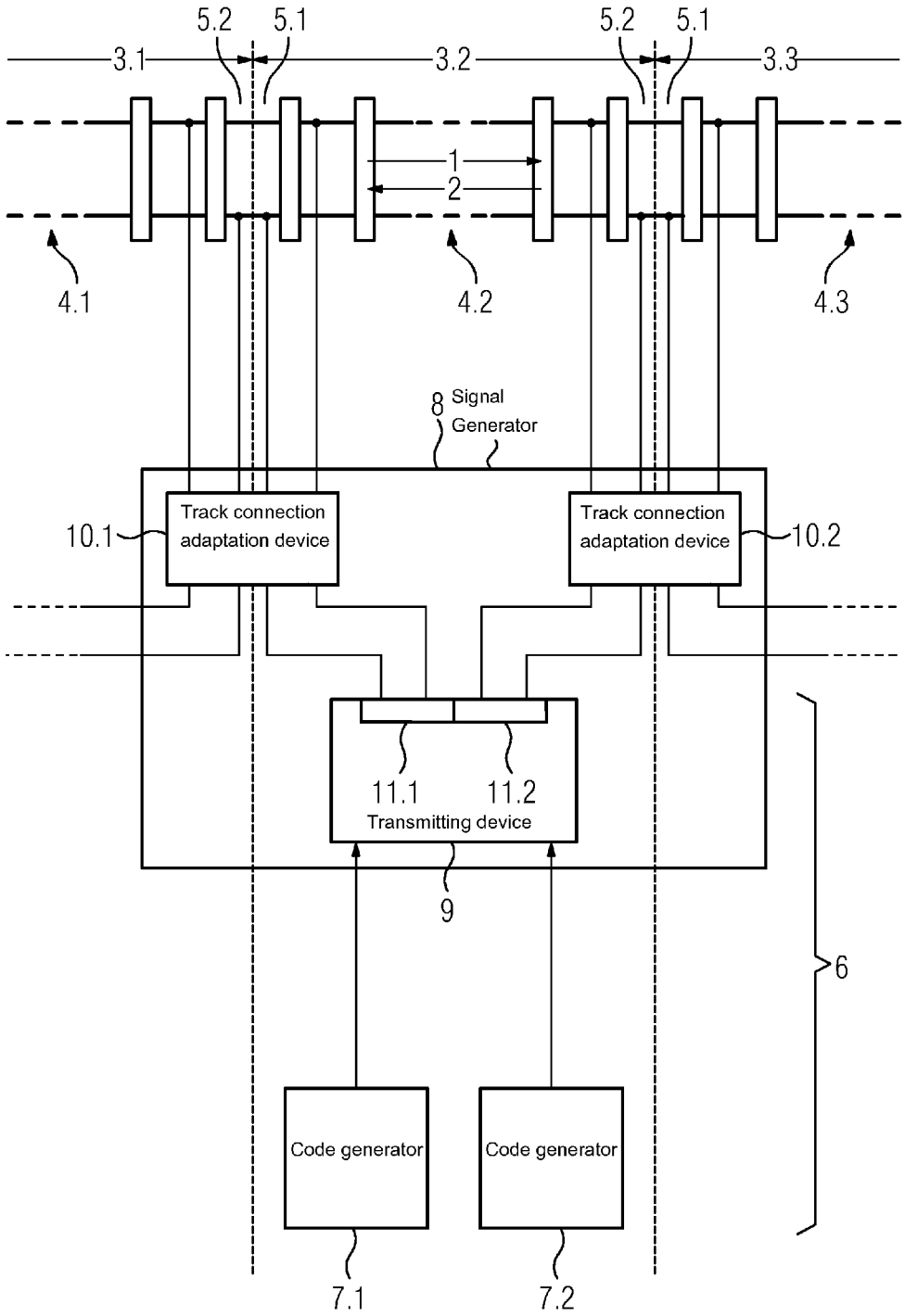
5.2
5.1
5.2
5.1
3.1
3.2
3.3
1
2
4.1
4.2
4.3
8
Signal Generator
Track connection adaptation device
Track connection adaptation device
10.1
10.2
11.1
11.2
Transmitting device
9
6
Code generator
Code generator
7.1
7.2

TRAIN CONTROL SYSTEM WITH PULSE-CODE-MODULATED CAB SIGNALING

BACKGROUND OF THE INVENTION

FIELD OF THE INVENTION

The invention relates to a train control system having pulse-code-modulated cab signaling, in particular for defining traveling speeds, wherein a code generator applies pulses to a signal generator as a function of the direction of travel, the output signal of said signal generator being fed into a track circuit covering a track section.

With this type of cab signaling, a pulse code, for example 180 pulses per minute, 120 pulses per minute, 75 pulses per minute or 0 pulses per minute, corresponding to the information that is to be transmitted to the cab of a rail vehicle, for example the maximum traveling speed, is transmitted on a fundamental frequency, for example 100 Hz, 250 Hz or 60 Hz. A track circuit serves as the transmission medium, the information being fed to one end or the other of the track section depending on the direction in which the rail vehicle enters the track section covered by the track circuit. Two separate transmission channels are required for this purpose. Depending on the direction of travel, one of said two channels must be switched to passive, while the second channel is used actively for signal generation.

This principle of cab signaling is widely established, in particular in the USA. In the basic version, four different pulse codes are generated by means of the code generator, thereby enabling four speeds to be defined. In this case the two travel-direction-specific transmission channels per track section or information section essentially consist of the code generator, the signal generator and a connection device for feeding the information into the track circuit.

BRIEF SUMMARY OF THE INVENTION

The object underlying the invention is to disclose a train control system of the generic type which is characterized by a simpler design, in particular by fewer components.

The object is achieved according to the invention in that the signal generator has a transmitting device for modulating the input signals of the two code generators and in that the transmitting device is connected via travel-direction-specific outputs in each case to a track connection adaptation device at one of the two entry ends of the track section.

In this way a single-channel architecture becomes possible for signal modulation. The known two-channel system comprising a duplication of all components is considerably simplified. Instead of two signal generators per track section, only a single generator is henceforth required.

It is particularly advantageous in this case that the transmitting device having the travel-direction-specific outputs can be designed in the manner of a transmitting device for an audio frequency track circuit. By using the transmitting device of an audio frequency track circuit provided per se for track vacancy detection in a manner, as it were, alien to its intended purpose a simple implementation of the single-channel signal generator is possible, in particular with regard to the development effort.

The direction of travel is switched over by activating one of the two outputs of the transmitting device, as a result of which only the required one of the two track connection adaptation devices at the entry ends of the track section is activated.

According to an embodiment of the invention, it is provided that the track connection adaption device is embodied for matching an output voltage of the transmitting device to a track connection voltage and its electrical isolation. This track connection adaption device having transformer impedance bridging can also be adapted by means of a track circuit by a track connection module of a track vacancy detection system. The track connection component of a low-frequency track circuit is particularly suitable for this purpose.

According to another embodiment of the invention, it is provided that the track connection adaption device is connected to the two transmitting devices of signal generators assigned to adjacent track sections. A particularly low investment in hardware is achieved as a result of this shared use of the signal generator for two adjacent track sections, i.e. information sections.

BRIEF DESCRIPTION OF THE SEVERAL VIEWS OF THE DRAWING

The invention is explained in more detail below with reference to an exemplary embodiment illustrated in the single FIGURE.

DESCRIPTION OF THE INVENTION

The figure shows the main components of a train control system according to the invention. It can be seen that a track along which rail vehicles can travel in both travel directions 1 and 2 is subdivided into track sections 3.1, 3.2, 3.3. In this scheme the track sections 3.1, 3.2, 3.3 belong to track circuits 4.1, 4.2, 4.3, into the entry ends 5.1 and 5.2 of which information is fed, in particular information relating to defined speed limits, for a rail vehicle traveling over said track sections. The information is specified in a signal box 6 for each travel direction 1 and 2 by means of a code generator 7.1 and 7.2 in the form of pulse duty factors. In this case a duty factor of 180 pulses per minute stands for track clear, 120 pulses per minute for reduced speed, etc. This pulse code is supplied for the respective travel direction 1 and 2 to a signal generator 8 which essentially consists of a transmitting device 9 and two track connection adaptation devices 10.1 and 10.2. The transmitting device 9 generates an output signal on a fundamental frequency, for example 60 Hz, using the pulse duty factor supplied by the code generator 7.1, 7.2. In accordance with the travel-direction-dependent origin of the pulse code, the output signal of the transmitting device 9 is forwarded via a first output 11.1 or a second output 11.2 to one of the two track connection adaptation devices 10.1 and 10.2. The track connection adaptation devices 10.1 and 10.2 are located outside of the signal box 6 in proximity to the entry end 5.1 or 5.2 of the track circuit 4.1, 4.2, 4.3 and essentially have the function of a supply transformer which converts the output voltage of the transmit pulses down to a few volts. In this arrangement each track connection adaptation device 10.1 and 10.2 is connected to the entry ends 5.1 and 5.2 of immediately adjacent track circuits and consequently also to signal generators 8 assigned thereto. By virtue of the two connection variants for both travel directions 1 and 2, only a single signal generator 8 is required for each track section 3.1, 3.2, 3.3 of each track circuit 4.1, 4.2, 4.3.

The invention claimed is:

1. A train control system having pulse-code-modulated cab signaling, the train control system comprising:

a track circuit covering a track section having two entry ends;

a signal generator supplying an output signal into said track circuit; and two code generators applying pulses to said signal generator as a function of a direction of travel;

said signal generator having a transmitting device configured to modulate input signals from said two code generators, track connection adaptation devices each disposed at a respective one of the two entry ends, and travel-direction-specific outputs each connected between said transmitting device and a respective one of said track connection adaptation devices.

2. The train control system according to claim 1, wherein said track connection adaptation devices are configured to match an output voltage of said transmitting device to a track connection voltage and its electrical isolation.

3. The train control system according to claim 1, wherein said signal generator is one of two signal generators each assigned to a respective one of two adjacent track sections, said transmitting device is one of two transmitting devices each assigned to a respective one of said two signal generators, and said track connection adaptation devices are each connected to a respective one of said two transmitting devices.

4. The train control system according to claim 1, wherein the pulse-code-modulated cab signaling defines traveling speeds.

* * * * *